United States Patent [19]

Elmore et al.

[11] Patent Number: 4,913,422

[45] Date of Patent: Apr. 3, 1990

[54] BARBELL HAVING HOLLOW INTERLOCKING WEIGHTS

[76] Inventors: Connie Elmore; Jennifer C. Elmore; John-Michael Elmore; Michael R. Elmore, all of 819 S. 4th St., Terre Haute, Ind. 47807

[21] Appl. No.: 257,207

[22] Filed: Oct. 13, 1988

[51] Int. Cl.[4] ..... A63B 13/00

[52] U.S. Cl. ..... 272/123; 272/117; 272/119

[58] Field of Search ..... 272/67, 68, 93, 116, 272/117, 122, 123, 130, 119; 224/148

[56] References Cited

U.S. PATENT DOCUMENTS

| | | | |
|---|---|---|---|
| D. 194,042 | 11/1962 | Guthormsen . | |
| D. 216,517 | 1/1970 | Dorn . | |
| D. 260,796 | 9/1981 | Uyeda . | |
| D. 271,408 | 11/1983 | Bauer . | |
| D. 279,120 | 6/1985 | Spangler . | |
| 916,813 | 3/1909 | Whitney | 272/122 |
| 3,231,270 | 1/1966 | Winer | 272/123 |
| 3,334,899 | 8/1967 | Basko et al. | 272/122 |
| 3,913,908 | 10/1975 | Speyer | 272/123 |
| 4,076,236 | 2/1978 | Ionel | 272/123 |
| 4,090,650 | 5/1978 | Gotta | 224/148 |
| 4,121,826 | 10/1978 | Liberatore | 272/123 X |
| 4,139,130 | 2/1979 | Glusker et al. | 224/148 |
| 4,293,126 | 10/1981 | Havens | 272/119 |
| 4,361,324 | 11/1982 | Bardi | 272/123 |
| 4,378,113 | 3/1983 | Piccini | 272/124 X |
| 4,384,714 | 5/1983 | Kimura | 272/119 |
| 4,482,151 | 11/1984 | Zwilling | 272/123 |

*Primary Examiner*—Richard J. Apley
*Assistant Examiner*—Robert W. Bahr
*Attorney, Agent, or Firm*—Woodard, Emhardt, Naughton Moriarty & McNett

[57] ABSTRACT

In one embodiment of the present invention, a tubular body defines a handle and sleeves at each end of the tubular body. Hollow fillable add-on weights include an outer wall that defines an annular step that is sized to be received within a sleeve of the tubular body. The add-on weights are engaged with the tubular body by a peg and thru-hole or dimple arrangement that holds the add-on weights against rotation and axial separation within the sleeve of the tubular body. The add-on weights and hollow body combine to form an annular indentation around which a strap-on weight can be fastened. The strap-on weight includes a hollow flexible elongated pouch, one surface of which includes a recess having a fill nozzle projecting therefrom onto which a cap can be mounted for filling the hollow pouch with water, sand or other suitable material. An attachment strap extends from one end of the pouch and includes a number of snap-on holes spaced along the length of the strap. The surface of the pouch also includes a pair of raised buttons projecting from a reinforced wall of the hollow pouch onto which the holes in strap are snapped so that the pouch can be retained in an encircling relationship.

8 Claims, 5 Drawing Sheets

BARBELL HAVING HOLLOW INTERLOCKING WEIGHTS

BACKGROUND OF THE INVENTION

The present invention relates to weight lifting and exercise apparatus such as barbells, dumbbells and weights therefore. More particularly, this invention addresses improvements in the design of hollow and interlocking barbells, dumbbells and weights.

SUMMARY OF THE INVENTION

In one embodiment of the invention, a dumbbell weight assembly comprises a hollow dumbbell having a first interior chamber, a first end defining a first fill nozzle opening into the first interior chamber, a first cap removably sealingly engaged on the first fill nozzle, and a second end defining a first recess. The dumbbell weight assembly further includes a number of hollow auxiliary weights adapted to be combined with the hollow dumbbell to increase the weight of the assembly. Each of the auxiliary weights includes a second interior chamber, a first face defining a second fill nozzle opening into the second interior chamber, a second cap removably sealingly engaged on the second fill nozzle, and a second face defining a second recess. The first recess in the dumbbell is adapted to receive the second cap therein when the second cap is engaged on the second fill nozzle of an auxiliary weight. The second recess in the auxiliary weight is adapted to receive the first cap therein when the first cap is engaged on the first fill nozzle of the dumbbell. An interlocking female channel and a locking male tab are interengaged between the first end of the dumbbell and the second face of the auxiliary weight when the first cap is received within the second recess. Another interlocking female channel and locking male tab are interengaged between the second end of the dumbbell and the first face of the auxiliary weight when the second cap is received within the first recess. Each of the hollow dumbbell and the auxiliary weights includes an annular indentation that is adapted to receive a strap-on weight thereabout. The strap-on weight comprises a hollow flexible pouch having a fill nozzle for filling the hollow pouch with water, sand or other suitable material. An attachment strap extends from one end of the pouch and includes a number of holes spaced along the length of the strap. The holes are adapted to removably engage a number of raised buttons projecting from a reinforced wall of the pouch so that the pouch is retained in an encircling relationship to encircle the annular recess of the dumbbell or auxiliary weights.

DESCRIPTION OF THE PREFERRED EMBODIMENTS

Figure 1:
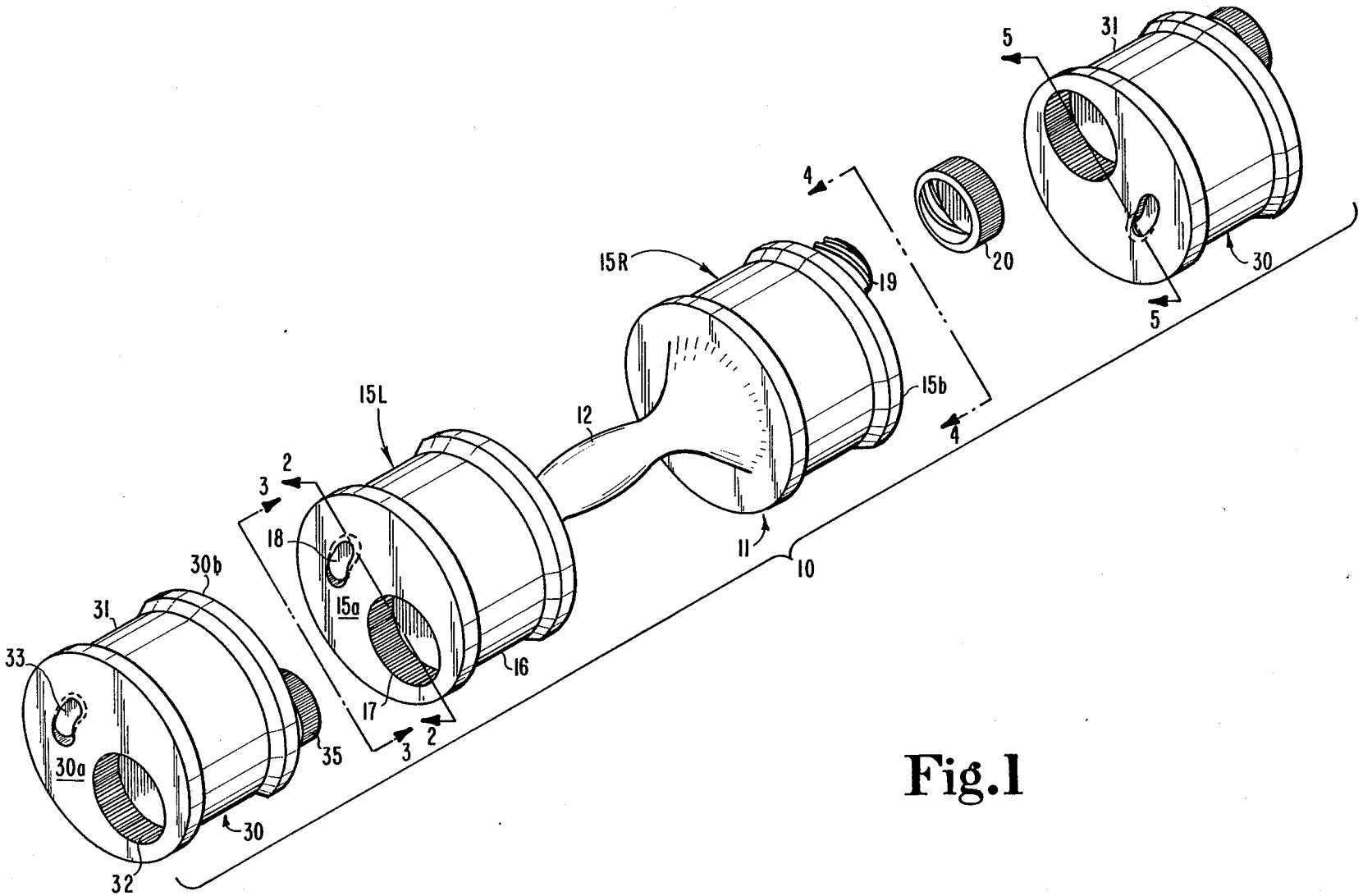
FIG. 1 is an exploded perspective view of the dumbbell weight assembly of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alternations and further modifications in the illustrated device, and such further applications of the principles of the invention as illustrated therein being contemplated as would normally occur to one skilled in the art to which the invention relates.

A dumbbell weight assembly 10 includes a dumbbell 11, as shown in FIG. 1. The dumbbell 11 includes an elongated handle 12 having a pair of end weights 15 integral with each end of the handle. The end weights 15 are generally cylindrical in shape and include an annular indentation 16 around the circumference of the end weight 15. The outer face **15*a* of the left end weight 15L includes an interlocking recess 17 and a female interlocking channel 18 extending inwardly from the outer face 15*a*. The outer face 15*b* of the right end weight 15R includes a fill nozzle 19 and a male locking tab 21 (FIG. 2) projecting outwardly from the outer face 15*b*. A cap 20 is provided to seal the fill nozzle 19**. The cap and nozzle may be threadedly engaged or arranged in a snap-fit relationship.

Figure 2:
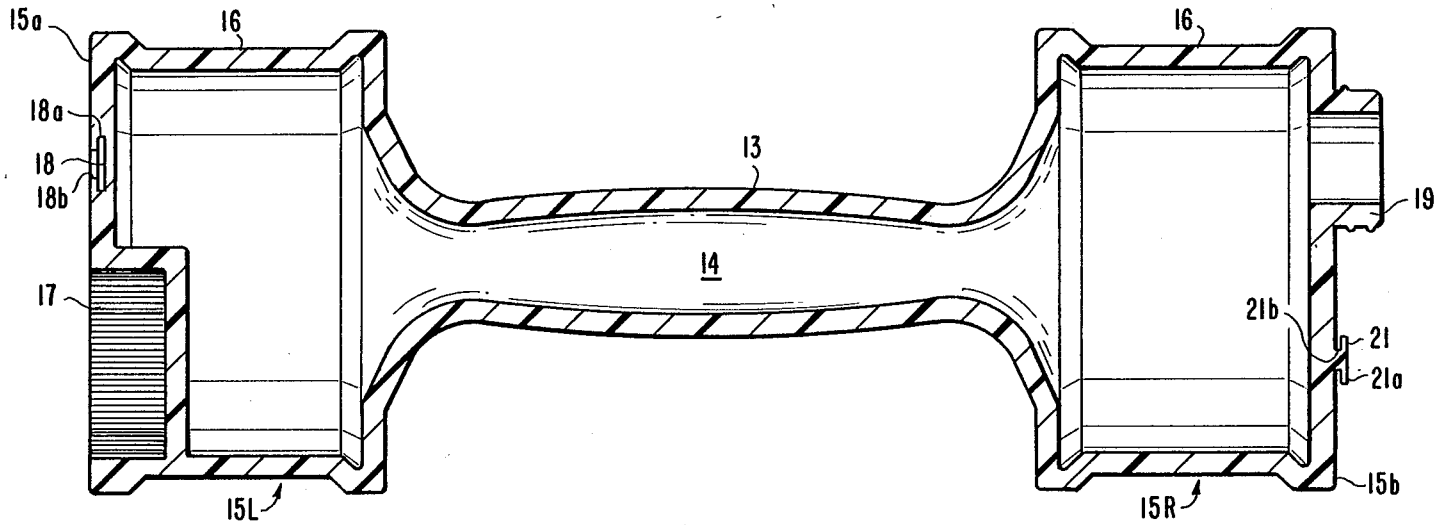
FIG. 2 is a cross-section of the dumbbell taken along line 2—2 in FIG. 1 as viewed in the direction of the arrows.

The dumbbell 11 is of hollow construction and includes a wall 13 defining an interior chamber 14, as shown in FIG. 2. In the preferred embodiment, the hollow dumbbell is formed from plastic in a typical molding process adapted to form hollow products, such as a blow molding process.

Figure 3:
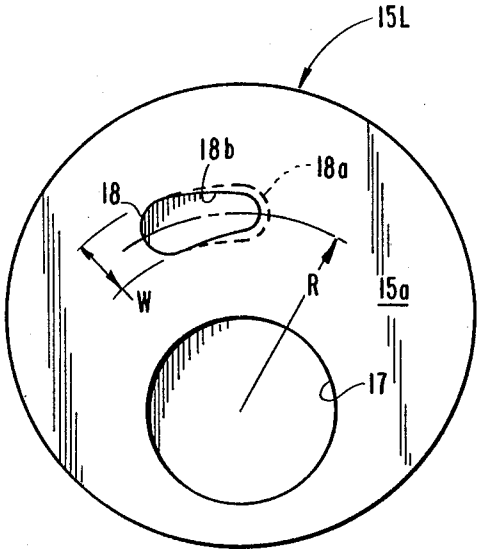
FIG. 3 is an end view of the dumbbell taken along line 3—3 in FIG. 1 as viewed in the direction of the arrows.

The interlocking channel 18 includes a T-slot **18*a* embedded below the outer face 15*a*, and an intersecting slot 18*b* that opens into the outer face 15*a* and intersects the T-slots 18*a*. As shown more clearly in FIG. 3, the T-slot 18*a* is kidney-shaped along a radius R measured from the center of the cylindrical recess 17. The T-slot 18*a* has a generally constant width W. The intersecting slot 18*b* has a gradually decreasing width along the length of the interlocking channel. This construction of the interlocking channel 18 is adapted to accommodate a locking tab, such as locking tab 21 (FIG. 2), and hold the locking tab within the T-slot 18*a***.

The interlocking recess 17 is cylindrical in shape and may include a number of serrations around the interior wall of the recess. The interlocking recess 17 is adapted to receive a cap, such as cap 20, when it is sealingly engaged on the fill nozzle 19. The serrations in the interlocking recess 17 form a gripping surface to restrain the rotation of the cap when it is within the recess 17.

Figure 4:
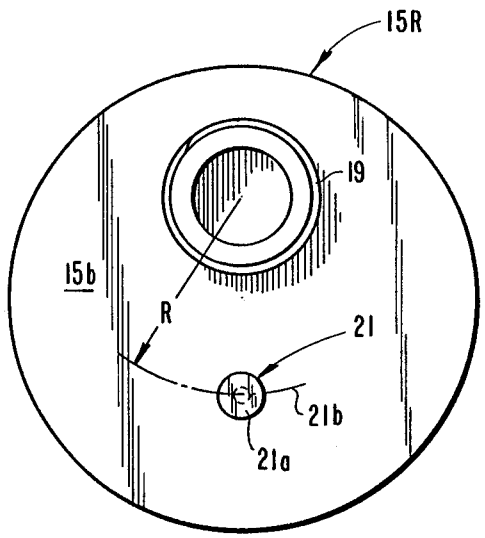
FIG. 4 is a view of the other end of the dumbbell taken along line 4—4 in FIG. 1 as viewed in the direction of the arrows.

Outer face **15*b* of the right end weight 15 R is shown in FIG. 4 with the fill nozzle 19 projecting therefrom. The locking tab 21 is centered on a radius R from the center of the fill nozzle 19 that corresponds to the radius from the center of the interlocking recess to the midline of the T-slot 18***a*. The locking tab includes a head portion 21*a* mounted atop a post 21*b* that is integral with the outer face 15*b*. The diameter of the head portion 21*a* is slightly less than the width W of the T-slot 18*a* so that the head portion can slide within the T-slot. The length of the post 21*b* corresponds to the distance that the T-slot 18*a* is inset below the outer face 15*a*. The diameter of the post 21*b* is sized to fit within the intersecting slot 18*b* at the narrowest portion of that slot.

Returning to FIG. 1, the dumbbell weight asembly 10 includes a plurality of auxiliary weights 30 that can be interlocked with the end weights 15L and 15R. While only two auxiliary weights 30 are shown in FIG. 1, the auxiliary weights are of a universal design so that several can be combined to increase the length and weight of the dumbbell weight assembly 10.

Figure 5:
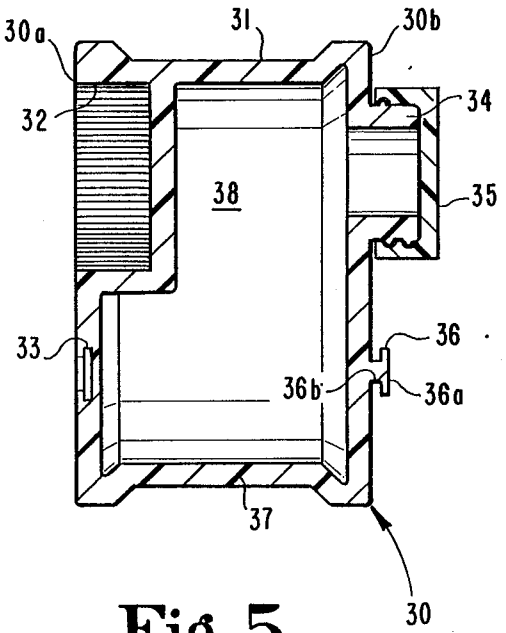
FIG. 5 is a cross-sectional view of the auxiliary weight taken along line 5—5 in FIG. 1 as viewed in the direction of the arrows.

Each of the auxiliary weights 30 is very similar in construction to the end weights 15 of the dumbbell 11. Each of the auxiliary weights 30 includes an annular indentation 31, an interlocking recess 32 and interlocking channel 33 on one face 30*a*, and a fill nozzle 34 and locking tab 36 on the other face 30*b*, as illustrated in FIG. 5. The outer wall 37 defines an interior chamber analogous to the chamber formed in the end weights. A cap 35 is adapted to be threaded onto the fill nozzle 34. Each of the features of the auxiliary weights 30 are identical to the corresponding features on the dumbbell 11. The auxiliary weights can also be formed from molded plastic. As shown in FIG. 1, the universal design of the auxiliary weights 30 allows the face 30*b* of the auxiliary weight 30 to mate with the outer face 15*a* of the left end weight 15L, while the face 30*a* of an auxiliary weight 30 can interlock with the outer face 15*b* of the right end weight 15R. Likewise, end weights can be combined by mating the face 30*a* of one end weight with the face 30*b* of another end weight.

In using the dumbbell weight assembly 10 of the present invention, the cap 20 is removed from the fill nozzle 19 of the dumbbell 11. Water, sand, lead shot, or other heavy, pourable material, can be poured into the fill nozzle 19 to fill the interior chamber 14. The weight of the dumbbell 11 will be determined by the volume of the interior chamber 14 and the density of the material poured into the chamber through the fill nozzle 19. Once the hollow dumbbell has been filled, the cap 20 is threaded onto the fill nozzle 19 to close the interior chamber 14, and the dumbbell 11 is ready for use. If more weight is desired, auxiliary weights 30 can be appended to the end weights 15L and 15R. The interior chamber 38 of each of the auxiliary weights 31 can be filled with the same or different material as that used to fill the dumbbell 11. Once the interior chamber 38 is filled, the cap 35 is engaged over the fill nozzle 34. To combine the auxiliary weight 30 with the dumbbell 11, the cap 35 and locking tab 36 are simultaneously inserted into the interlocking recess 17 and the interlocking channel 18, respectively. When the locking tab 36 is fully inserted into the interlocking channel 18, the end weight 30 is pivoted, or rotated, about the cap 35 so that the head portion 36*a* moves along the T-slot 18*a* until it reaches the end of the T-slot. At the end of the T-slot, the intersecting T-slot 18*b* is narrow enough to retain the head portion 36*a* of the locking tab within the T-slot 18*a*.

The friction between the cap 35 and the serrations on the inner wall of the interlocking recess 17 prevents the end weight 30 from rotating in the opposite direction to disengage the locking tab from the interlocking channel. An arrow may be impressed upon the face 30*b* of the auxiliary weight 30 to show the direction in which the auxiliary weight 30 must be rotated in order to entrench the locking tab within the T-slot 18*a*. A similar procedure is followed to combine an auxiliary weight 30 with the right end weight 15R. The same procedure is followed to combine additional auxiliary weights in order to increase the weight of the dumbbell weight assembly 10.

The dumbbell weight assembly of the present invention has been illustrated with the interlocking recess and interlocking channel on the same face of the end weight or auxiliary weight. It is understood, however, that the locking tab may be situated on the face having the interlocking recess, and the interlocking channel located on the face having the fill nozzle. Thus, either of the male or female interlocking features may be combined with the recess or fill nozzle to create the interlocking feature of the present invention.

The dumbbell weight assembly 10 can be sized for use as a typical dumbbell or hand weight. In addition, the dimensions of the features of the dumbbell 11 and auxiliary weights 30 can be increased or function as a barbell and to increase the weight capability of the assembly.

Figure 6:
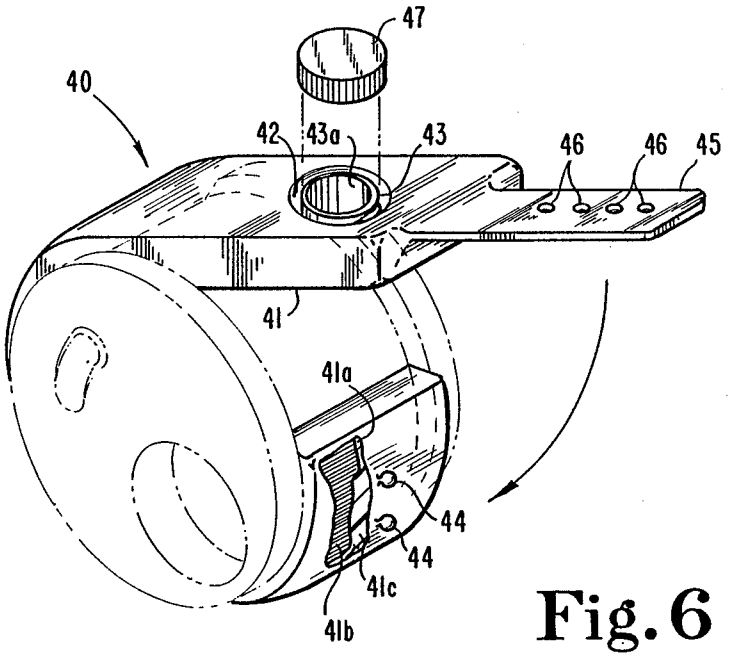
FIG. 6 is an enlarged perspective view with a partial cutaway of a flexible strap-on weight for use with the dumbbell weight assembly of the present invention shown in FIG. 1.

In another embodiment of the present invention, a strap-on weight 40, as shown in FIG. 6, is provided that can be wrapped around the annular indentation 16 in the end weight 15 or indentation 31 of the auxiliary weight 30. The strap-on weight 40 includes a pouch 41 having an outer wall 41*a* that defines an interior chamber 41*b*. The pouch 41 is of a generally elongated rectangular shape having a width equal to or less than the width of the annular indentations 16 and 31. A recess 42 is formed on one face of the pouch 41 with a fill nozzle 43 situated within the recess 42. The nozzle 43 includes a fill opening 43*a* formed by the outer wall 41*a* that opens into the interior chamber 41*b*. The fill nozzle 43 is situated within the recess 42 to allow room for a cap 47 to be threaded onto the fill nozzle 43.

An attachment strap 45 extends from one end of the pouch 41. The attachment strap 45 includes a number of snap-on holes 46 distributed along the length of the strap. At the opposite end of the pouch 41 are a pair of raised buttons 44. The raised buttons are integral with a reinforced wall portion 41*c* of the pouch 41. The raised buttons 44 have an enlarged head so that the bottons can be pressed through the snap-on holes 46 to hold the strap in place and the strap-on weights 40 in an encircling arrangement. In the preferred embodiment, the strap-on weight 40 is composed of a soft moldable plastic that is sufficiently strong to avoid rupture.

In the use of the strap-on weight 40, the pouch 41 is wrapped around the annular indentation 16 or 31 of an end weight 15 or an auxiliary weight, respectively. The pair of sanp-on holes 46 are oriented over the pair of raised buttons 44 and snap onto the raised buttons to hold the strap-on weight 40 in place. The strap-on weight 40 can be filled before or after the pouch has been wrapped around the end weight 15; however, it is generally easier to fill the pouch 41 after the strap-on weight 40 has been attached to the end weight. While the strap-on weight 40 has been illustrated as being combined with the dumbbell weight assembly 10, the strap-on weight 40 is equally well-adapted to being wrapped around the wrist or ankles of a person if sized appropriately. The strap-on weight can also be sized to fit the dimensions of a barbell-sized assembly.

Figure 7:
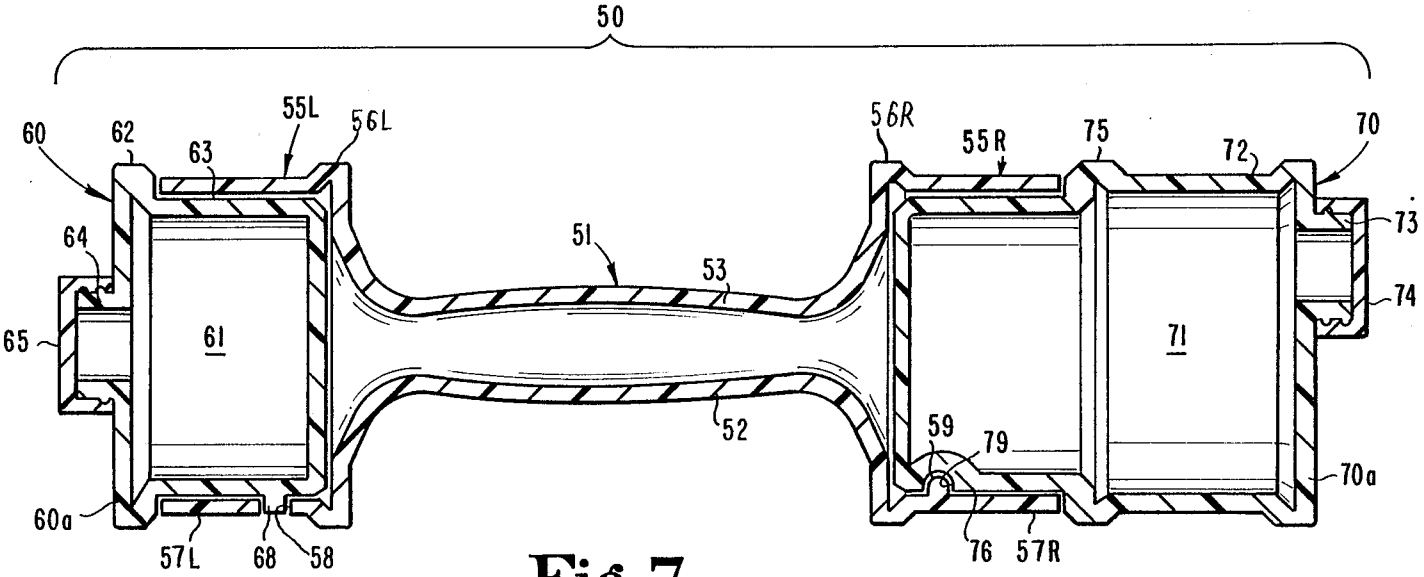
FIG. 7 is a cross-sectional view of the dumbbell and add-on weights of another embodiment of the dumbbell weight assembly of the present invention.

In another embodiment of the present invention, a dumbbell weight assembly 50, shown in FIG. 7, includes a tubular body 51 having a wall 53 that defines a dumbbell handle 52. The tubular body 51 is similar in shape to the dumbbell 11 of a previous embodiment, except that the outer faces 15*a* and 15*b* of the dumbbell 11 have been removed. The tubular body 51 includes end sleeves 55L and 55R formed by annular steps 57L and 57R extending from shoulders 56L and 56R, respectively. Unlike the dumbbell 11 of the previous embodiment, the tubular body 51 of the present embodiment is an open shell and, therefore, cannot be filled with an iert substance to serve as an exercise weight. However, it is within the scope of this invention to make the handle 52 solid to add weight and rigidity to the dumbbell weight assembly 50.

The dumbbell weight assembly 50 of the present embodiment includes an array of hollow fillable add-on weights that are attached to the tubular body 51, as described herein, to add weight to the assembly. A first add-on weight 60 is similar in overall construction to the auxiliary weight 30 of a previous embodiment, except that the interlocking features of that auxiliary weight 30 have been eliminated in this embodiment. Add-on weight 60 is hollow, having an interior chamber 61. A fill nozzle 64 opens into the interior chamber 61 to provide a means to fill the add-on weight 60 with an inert substance to increase its weight. A cap 65 is provided to sealingly engage the fill nozzle 64. The outer wall 60*a* of the add-on weight 60 defines an annular shoulder 62 and an annular step 62 that is sized to fit tightly within the end sleeve 55L of the tubular body 51. The shoulder 62 abuts the end of the sleeve 55L when the add-on weight is attached. The combination of the annular step 57L of the tubular body 51 and the add-on weight 60 approximates the annular indentation 16 of the dumbbell 11 of the former embodiment. A strap-on weight 40 can be engaged about the annular step 57L between the shoulder 56L of the tubular body, and the shoulder 62 of the add-on weight.

A second add-on weight 70 includes an interior chamber 71, defined by the wall 70*a*, that can also be filled to increase the weight of the add-on weight 70. A fill nozzle 73 and cap 74 provide the means to fill the interior chamber 71. One portion of the second add-on weight 70 defines an annular indentation 72 identical to the annular indentation 16 of the dumbbell 11 described herein. A strap-on weight, such as strap-on weight 40 described above, can be engaged about the annular indentation 72. Another portion of the second add-on weight 70 defines an annular step 76 extending from annular shoulder 75 and identical to the annular step 62 of the first add-on weight 60 described above. The annular step 76 of the second add-on weight 70 fits snugly into the end sleeve 57R of the tubular body 51 so that its shoulder 75 abuts the sleeve 56R. It is understood that, as thus far described, either of the add-on weights 60 or 70 can be inserted into either end sleeve 57L or 57R of the tubular body 51.

In the preferred embodiment, the add-on weights 60 and 70 are locked in engagement with the tubular body 51 using a peg and thru-hole or recess. The first add-on weight 60 includes a protuberance, such as peg 68, projecting outwardly from the annular step 62. The peg 68 extends through the thru-hole 58 in the annular step 57L of the tubular body. When engaged in the thru-hole 58, the peg 68 locks the first add-on weight 60 against rotation and axial separation within the end sleeve 55L.

Alternatively, a peg can project from the interior of the end sleeve, such as peg 59 integral with end sleeve 55R. A dimple 79 is formed in the annular step 76 of the add-on weight 70. When the add-on weight 70 is inserted into the end sleeve 55R, the peg 59 locks into dimple 79 to firmly connect the second add-on weight 70 to the tubular body 51.

It is understood that either of the end sleves 55L and 55R can incorporate either the thru-hole 58 or the peg 59. Likewise, either of the add-on weights 60 or 70 can include the peg 68 or dimple 79 as appropriate to engage the end sleeves of the tubular body. In either case, the dumbbell weight assembly 50 is composed of a material sufficiently elastic and resilient to allow the peg and thru-hole or recess locking feature to deform enough for engagement and disengagement, yet rigid enough to keep the add-on weights locked on the tubular body when the add-on weights are filled with an inert substance. The present invention also contemplates a circumferential ridge and circumferential channel arrangement in lieu of the peg 59 and dimple 79, whereby a protruding ridge around the inner circumference of the sleeve 55R would engage within a channel about the circumference of the annular step 76. Such an arrangement would prevent axial separation of the add-on weight from the tubular body, but would allow some relative rotation between the two components.

It is understood that the first and second add-on weights 60 and 70 may incorporate the interlocking features of the auxiliary weight 30 so that more weight can be added to the dumbbell weight assembly 50. In particular, the fill nozzles 64 and 73 of the two add-on weights can be arranged on the exposed face of the add-on weights in a manner similar to the arrangement of the fill nozzle 34 on the second face 30*b* of the auxiliary weight. Either an interlocking channel, such as channel 33, or a locking tab, such as tab 36, can be incorporated onto the add-on weights so that an auxiliary weight, such as auxiliary weight 30, can be mated to the dumbbell weight assembly 50.

The dumbbell weight assemblies 10 and 50, and the strap-on weights 40 of the present invention represent an improvement over hollow and interlocking weights of the prior art. Each of the dumbbell 11, tubular body 51, auxiliary weight 30, add-on weights 60 and 70, and strap-on weights 40 can be made of one-piece construction, except for the caps for the fill nozzles. The end weights and auxiliary weight 30 each include unique interlocking features in which the fill nozzle and sealing cap are used to mate the different weights in the assembly. The interlocking channel and tab arrangement is simple to manufacture and uncomplicated to use in appending and locking several weights together. Likewise, the unique locking peg and thru-hole or dimple of the add-on weights 60 and 70 are simple to manufacture and use. The interlocking features of the present invention eliminate the need for a single bar on which multiple weight rings are mounted. The several combinable weights of this invention are easier to store than the bar and weight rings of some prior art apparatus. The strap-on weight 40 represents a compact means for increasing the weight of a barbell or dumbbell without increasing the length of the assembly. The versatility of the strap-on weight is demonstrated by its ability to be used as an ankle or wrist weight.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A dumbbell weight assembly comprising:

a tubular body having an outer wall defining an elongated handle and a sleeve at each end of said handle;

a number of hollow add-on weights, each of said add-on weights having an outer wall defining;

an interior chamber;

means for filling said interior chamber with an inert substance; and an annular step sized to be slidably received within said sleeve; and resiliently deformable means, between said sleeve and said annular step, for removably engaging one of said number of hollow add-on weights within said sleeve at either end of said handle when said annular step is slidably received within said sleeve.

2. The dumbbell weight assembly of claim 1, wherein said means for removably engaging includes:

a protuberance in either of said sleeve or said annular step; and means for receiving said protuberance in the other of said sleeve or said annular step.

3. The dumbbell weight assembly of claim 2, wherein:

said sleeve includes an inner surface with said protuberance projecting inwardly therefrom;

said annular step includes an outer surface facing said inner surface of said sleeve; and said means for receiving said protuberance includes a dimple formed in said outer surface of said annular step.

4. The dumbbell weight assembly of claim 2, wherein:

said annular step includes an outer surface with said protuberance projecting outwardly therefrom;

said sleeve includes an inner surface facing said outer surface of said annular step; and said means for receiving said protuberance includes an opening formed in said inner surface of said sleeve.

5. A weighted exercise device comprising:

a flexible elongated pouch having an outer wall having an exterior surface and defining an interior chamber, and defining a recess having a fill nozzle within said recess, said fill nozzle opening into said interior chamber;

a cap removably sealingly engaged on said fill nozzle so that a top surface of said cap is generally flush with said exterior surface;

a strap integral with one end of said pouch, said strap defining a number of holes therethrough;

a number of buttons projecting from said outer wall at the other end of said pouch, said number of buttons adapted to extend through said number of holes in removable locking engagement, whereby;

said pouch is arranged in an encircling relationship when said number of buttons is in locking engagement with said number of holes;

wherein said outer wall includes a reinforced portion adjacent said number of buttons opposite said exterior surface.

6. A dumbbell weight assembly comprising:

a tubular body having an outer wall defining an elongated handle and a sleeve at each end of said handle;

a number of hollow add-on weights, each of said add-on weights having an outer wall defining;

an interior chamber;

means for filling said interior chamber with an inert substance; and an annular step sized to be received within said sleeve; and means, between said sleeve and said annular step, for removably engaging one of said number of hollow add-on weights within said sleeve at either end of said handle; wherein said dumbbell weight assembly further comprises a weighted strap having means for removably retaining said strap in an encircling relationship about said sleeve of said tubular body;

said outer wall of said tubular body defines a first annular shoulder between said handle and said sleeve;

said outer wall of said add-on weight defines a second annular shoulder adjacent said annular step, whereby, when said add-on weight is engaged within said sleeve, said first shoulder, said sleeve and said second shoulder define an annular indentation adapted to receive said weighted strap in said encircling relationship about said sleeve.

7. A dumbbell weight assembly comprising:

a tubular body having an outer wall defining an elongated handle and a sleeve at each end of said handle;

a number of hollow add-on weights, each of said add-on weights having an outer wall defining;

an interior chamber;

means for filling said interior chamber with an inert substance; and an annular step sized to be received within said sleeve; and means, between said sleeve and said annular step, for removably engaging one of said number of hollow add-on weights within said sleeve at either end of said handle;

a weighted strap having means for removably retaining said strap in an encircling relationship; and means, including a first annular indentation defined by said outer wall of said add-on weight, for removably receiving said weighted strap in said encircling relationship about said add-on weight, wherein said weighted strap is engaged about and received within said first annular indentation.

8. The dumbbell weight assembly of claim 7, wherein:

said outer wall of said tubular body defines a first annular shoulder between said handle and said sleeve;

said outer wall of said add-on weight defines a second annular shoulder between said annular step and said first annular indentation, whereby, when said add-on weight is engaged within said sleeve, said first shoulder, said sleeve and said second shoulder define a second annular indentation adapted to receive said weighted strap in said encircling relationship about said sleeve.

* * * * *